US006875027B2

(12) United States Patent
Ye et al.

(10) Patent No.: US 6,875,027 B2
(45) Date of Patent: Apr. 5, 2005

(54) ELECTRICAL CONNECTOR ASSEMBLY WITH COMPLEMENTARY RECESS AND PROJECTION INTERENGAGEMENT

(75) Inventors: Hui Ye, Kunsan (CN); Xue Gong Lei, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 32 days.

(21) Appl. No.: 10/407,526

(22) Filed: Apr. 3, 2003

(65) Prior Publication Data

US 2004/0058568 A1 Mar. 25, 2004

(30) Foreign Application Priority Data

Sep. 25, 2002 (TW) ..... 91215144 U

(51) Int. Cl.[7] ..... H01R 12/00

(52) U.S. Cl. ..... 439/74; 439/345; 439/660; 439/680

(58) Field of Search ..... 439/74, 680, 660, 439/345, 350, 357

(56) References Cited

U.S. PATENT DOCUMENTS 4,113,179 A * 9/1978 McKee ..... 439/354
4,365,857 A * 12/1982 Watanabe et al. ..... 439/79
4,445,742 A * 5/1984 Fullam ..... 439/597
4,481,458 A * 11/1984 Lane ..... 320/112
4,571,017 A * 2/1986 Fujita ..... 439/603
5,183,405 A * 2/1993 Elicker et al. ..... 439/108
5,224,866 A * 7/1993 Nakamura et al. ..... 439/81
5,249,977 A * 10/1993 Tanaka et al. ..... 439/135
5,395,265 A * 3/1995 DiMondi et al. ..... 439/553
5,478,253 A * 12/1995 Biechler et al. ..... 439/181
5,545,051 A * 8/1996 Summers et al. ..... 439/350
5,547,385 A * 8/1996 Spangler ..... 439/101
5,586,893 A * 12/1996 Mosquera ..... 439/108
5,626,482 A * 5/1997 Chan et al. ..... 439/74
5,876,248 A * 3/1999 Brunker et al. ..... 439/608
5,879,169 A * 3/1999 Wu ..... 439/74
5,885,093 A * 3/1999 Champion et al. ..... 439/101
6,010,370 A * 1/2000 Aihara et al. ..... 439/660
6,200,146 B1 * 3/2001 Sarkissian ..... 439/79
6,220,903 B1 * 4/2001 Huang ..... 439/894
6,343,951 B1 * 2/2002 Ono et al. ..... 439/571
6,394,833 B1 * 5/2002 Bulmer et al. ..... 439/393
6,471,539 B1 * 10/2002 Yu ..... 439/489
6,474,996 B2 * 11/2002 Watanabe et al. ..... 439/66
6,645,005 B2 * 11/2003 Wu ..... 439/563

* cited by examiner

*Primary Examiner*—Tho D. Ta
*Assistant Examiner*—Larisa Tsukerman
(74) *Attorney, Agent, or Firm*—Wei Te Chung

(57) ABSTRACT

An electrical connector assembly (1) includes a first connector (10) and a second connector (20) mated with the first connector. The first connector includes a first housing (100), and a plurality of first terminals (104) received in the first housing. The first housing includes a protruding portion (102) defining two recesses (1023). Each recess has two first interference blocks (1025). The second connector includes a second housing (200), and a plurality of second terminals (204) received in the second housing. The second housing includes a receiving space (202), for receiving the protruding portion of the first connector. The receiving space includes two projections (2023) corresponding to the recesses of the first connector. Each projection has two first interference blocks (2025) interferentially engaging with the corresponding first interference blocks of the protruding portion. As a result, retention force between the first connector and the second connector is reinforced.

16 Claims, 4 Drawing Sheets

ELECTRICAL CONNECTOR ASSEMBLY WITH COMPLEMENTARY RECESS AND PROJECTION INTERENGAGEMENT

BACKGROUND OF THE INVENTION

1. Field of the Invention

The present invention relates to an electrical connector assembly, and particularly to a board-to-board connector assembly.

2. Description of Prior Art

Board-to-board connector assemblies are widely used to electrically connect circuit boards with other circuit boards. A board-to-board connector assembly comprises a first connector, and a second connector mated with the first connector. "Board-to-board Connectors Offer Design Flexibility" (Connector Specifier Magazine, April 2000) describes this kind of connector assembly.

U.S. Pat. No. 5,554,036 discloses a conventional board-to-board connector assembly. The board-to-board connector assembly comprises a first connector and a second connector, for electrically connecting a circuit board and another circuit board. The first connector is mated with the second connector by friction between the first connector and the second connector. However, the friction between the first connector and the second connector is frequently insufficient for the first connector and the second connector to be stably mated together. In addition, there is no supplementary fixing structure between the first connector and the second connector. Accordingly, the first connector is easily displaced from the second connector in use of the connector assembly. This results in partial or total failure of electrical connection between said circuit boards.

FIG. 5 illustrates another conventional board-to-board connector assembly 3. The connector assembly 3 comprises a first connector 40, and a second connector 50 mated with the first connector 40. The first connector 40 comprises a first housing 400 including a bottom wall 401, two first longitudinal walls 403 and two first lateral walls 402, thereby defining a receiving space 404 therebetween. Each second lateral wall 402 defines a recess 4020. The second connector 50 comprises a second housing 500 having a protruding portion 504 received in the receiving space 404 of the first connector 40. The protruding portion 504 comprises a top wall 501, two second longitudinal walls 503, and two second lateral walls 502. Each second lateral wall 502 comprises a projection block 5020. The projection blocks 5020 are engaged in the recesses 4020 of the first connector 40, for interferentially mating the first connector 40 with the second connector 50.

In use, the projection block 5020 of the second connector 50 is mated or unmated at the recess 4020 of the first connector 40. Frequent mating or unmating operations cause abrasion of the projection blocks 5020. This eventually results in failure of stable connection of the projection blocks 5020 in the recesses 4020. This can lead to failure of electrical connection between one circuit board and another corresponding circuit board.

An electrical connector assembly that overcomes the above-mentioned problems is desired.

SUMMARY OF THE INVENTION

Accordingly, an object of the present invention is to provide an electrical connector assembly having recesses and projections which facilitate firmly and secure mating of a first connector with a second connector.

In order to achieve the above object, an electrical connector assembly in accordance with a preferred embodiment of the present invention comprises a first connector, and a second connector mated with the first connector. The first connector comprises a first housing, and a plurality of first terminals received in the first housing. The first housing comprises a protruding portion having two opposite first contact walls and two opposite first matching walls. Each matching wall defines a recess having two first interference blocks at opposite sides thereof. The second connector comprises a second housing, and a plurality of second terminals received in the second housing. The second housing comprises a receiving space receiving the protruding portion of the first connector. The receiving space comprises a pair of projections corresponding to the recesses of the first connector. Each projection has two opposite second interference blocks. When the first connector is mated with the second connector, the first interference blocks of the first connector are fittingly and interferentially engaged with the second interference blocks of the second connector.

Other objects, advantages and novel features of the present invention will become more apparent from the following detailed description when taken in conjunction with the accompanying drawings, in which:

DESCRIPTION OF THE PREFERRED EMBODIMENT

Reference will now be made to the drawings to describe the present invention in detail.

Figure 1:
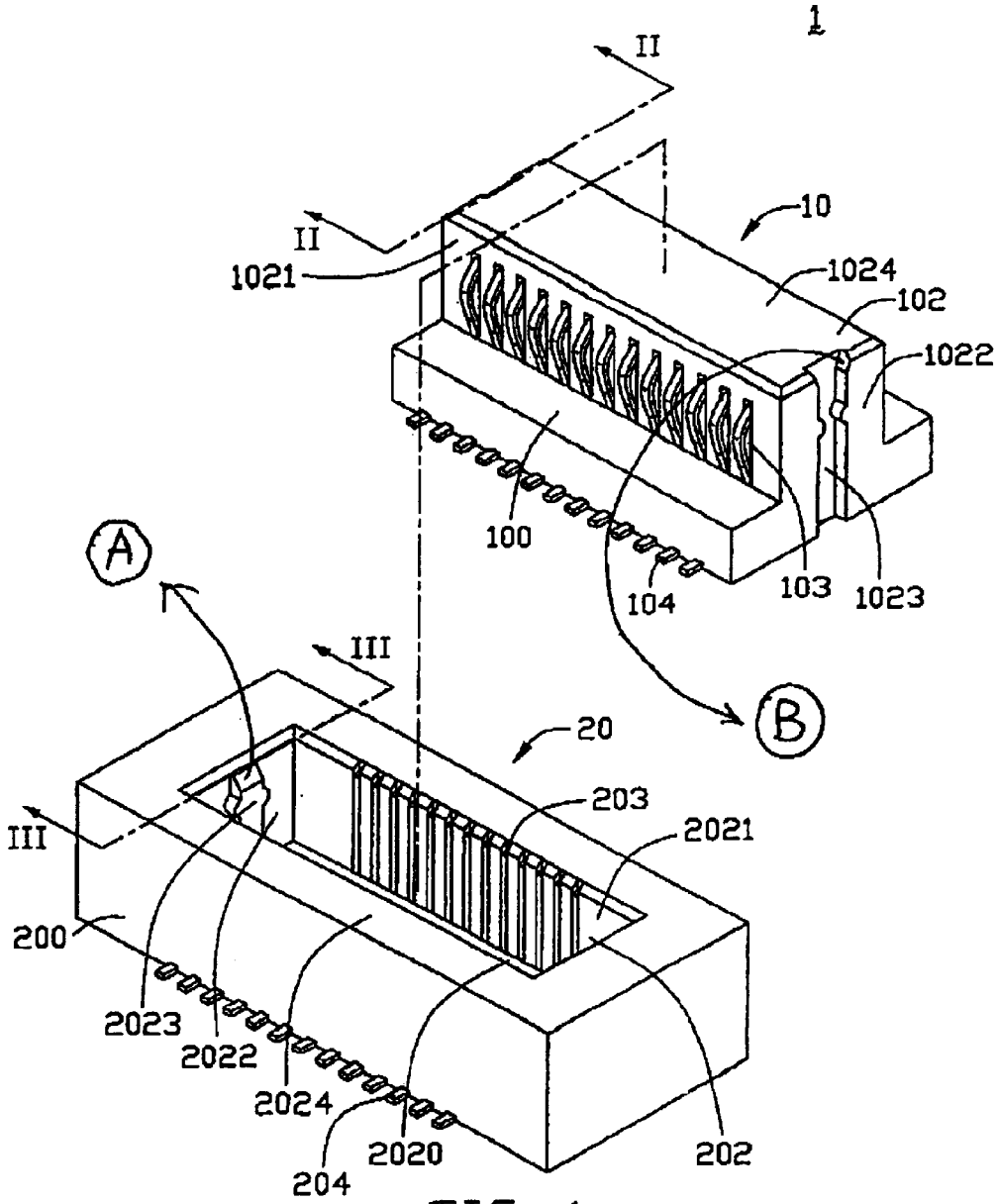
FIG. 1 is an exploded, isometric view of an electrical connector assembly in accordance with the preferred embodiment of the present invention.

Referring to FIG. 1, an electrical connector assembly 1 for electrically connecting a circuit board (not shown) and another circuit board (not shown) in accordance with the preferred embodiment of the present invention comprises a first connector 10, and a second connector 20 adapted for being mated with the first connector 10.

The first connector 10 comprises a first housing 100. The first housing 100 comprises a rectangular protruding portion 102. The protruding portion 102 comprises a pair of opposite longitudinal first contact walls 1021, a pair of opposite lateral first matching walls 1022 respectively interconnecting the first contact walls 1021, and a first top wall 1024 perpendicular to both the first contact walls 1021 and the first matching walls 1022. Each first contact wall 1021 defines a multiplicity of first passageways 103 receiving a multiplicity of first terminals 104, respectively. Each first matching wall 1022 defines a central recess 1023.

The second connector 20 comprises a second housing 200. The second housing 200 defines a receiving space 202 corresponding to the protruding portion 102 of the first housing 100, and comprises a second top wall 2024. When the second connector 20 is mated with the first connector 10, the protruding portion 102 of the first housing 100 is completely received within the receiving space 202 of the second housing 200. The receiving space 202 is bounded by a pair of opposite longitudinal second contact walls 2021, a pair of opposite lateral second matching walls 2022 respectively interconnecting the second contact walls 2021, and a bottom wall 2020 opposite from the second top wall 2024. The bottom wall 2020 and the second top wall 2024 each are perpendicular to both the second contact walls 2021 and the second matching walls 2022. Each second contact wall 2021 defines a multiplicity of second passageways 203 receiving a multiplicity of second terminals 204, respectively. When the first connector 10 and the second connector 20 are mated, the second terminals 204 of the second connector 20 are electrically connected with the first terminals 104 of the first connector 10. Each second matching wall 2022 comprises a central projection 2023. The central projections 2023 correspond to the recesses 1023 of the first housing 100.

Figure 2:
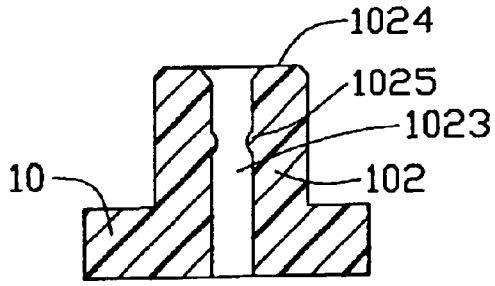
FIG. 2 is a cross-sectional view of a first connector of the connector assembly of FIG. 1, taken along line II—II of FIG. 1.

Referring also to FIG. 2, each recess 1023 is defined vertically through a center of its corresponding first matching wall 1022 of the first housing 100. A pair of curved first interference blocks 1025 protrudes from opposite two inner sidewalls bounding the recess 1023, proximate to the first top wall 1024 of the protruding portion 102. The recess 1023 is flared at the first top wall 1024, for facilitating insertion of the projection 2023 of the second housing 200 thereinto.

Figure 3:
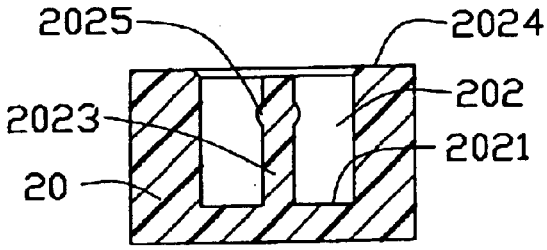
FIG. 3 is a cross-sectional view of a second connector of the connector assembly of FIG. 1, taken along line III—III of FIG. 1.

Referring also to FIG. 3, each projection 2023 is formed vertically in a center of its corresponding second matching wall 2022 of the second housing 200. The projection 2023 comprises a pair of curved second interference blocks 2025 protruding from opposite two sidewalls thereof, proximate to the second top wall 2024. The projection 2023 has a chamfer face in one end thereof adjacent to the second top wall 2024, for facilitating mating of the first connector 10 with the second connector 20.

Figure 4:
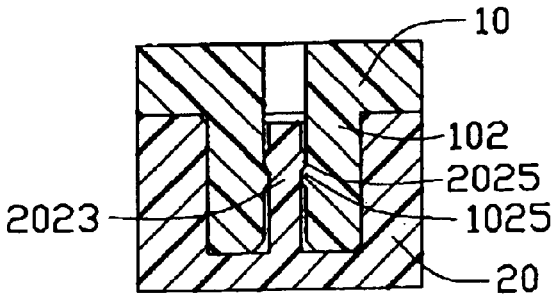
FIG. 4 is a cross-sectional view of the first connector of FIG. 2 mated with the second connector of FIG. 3.

Referring particularly to FIG. 4, when mating the first connector 10 with the second connector 20, the protruding portion 102 of the first housing 100 is inserted into the receiving space 202 of the second housing 200. The projections 2023 of the second connector 20 are slidingly engaged in the recesses 1023 of the first connector 10. The first interference blocks 1025 of the first connector 10 resiliently ride over the second interference blocks 2025 of the second connector 20, whereupon the first interference blocks 1025 are fittingly and interferentially located at a side of the second interference blocks 2025 that is nearest the bottom wall 2020 of the second connector 20. Thus, retention force between the second interference blocks 2025 of the second connector 20 and the first interference blocks 1025 of the first connector 10 is reinforced. Accordingly, the first connector 10 is firmly and securely mated with the second connector 20. As a result, mechanical and electrical connection between the first terminals 104 of the first connector 10 and the second terminals 204 of the second connector 20 is stable and reliable.

Figure 5:
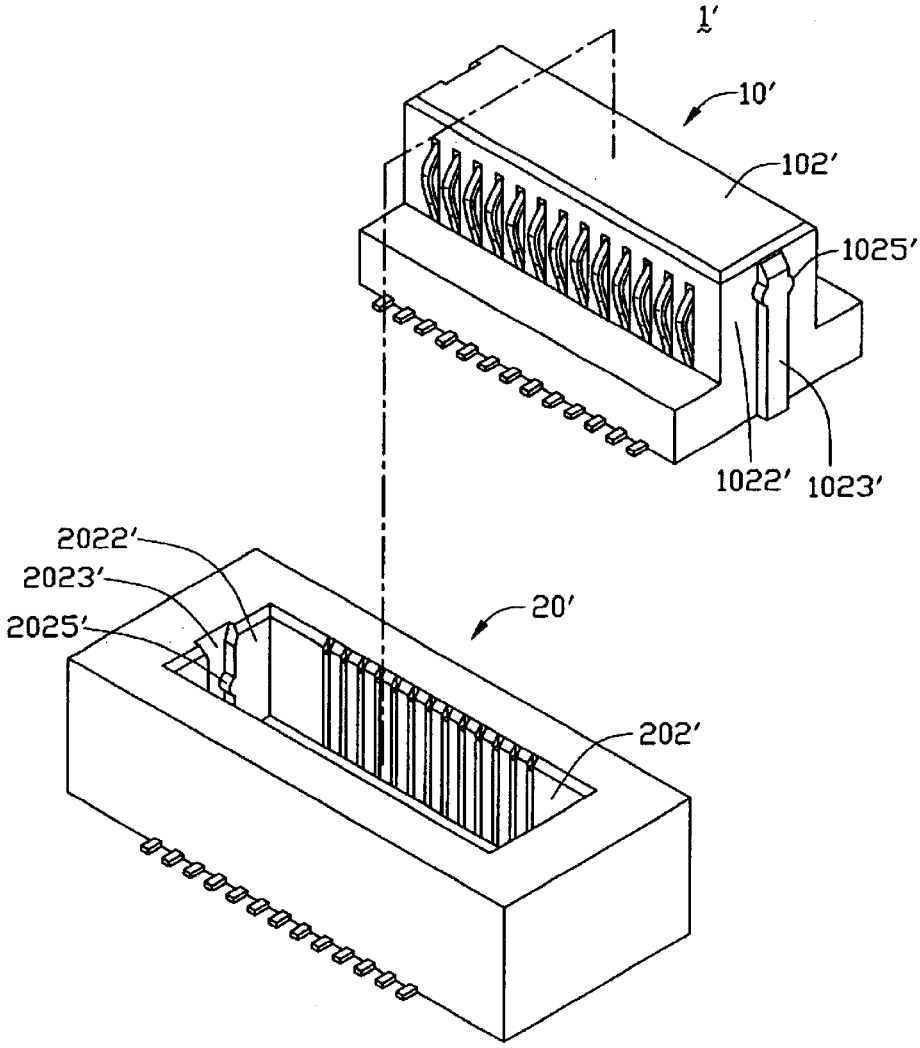
FIG. 5 is an exploded, isometric view of an electrical connector assembly in accordance with an alternative embodiment of the present invention.
Figure 6:
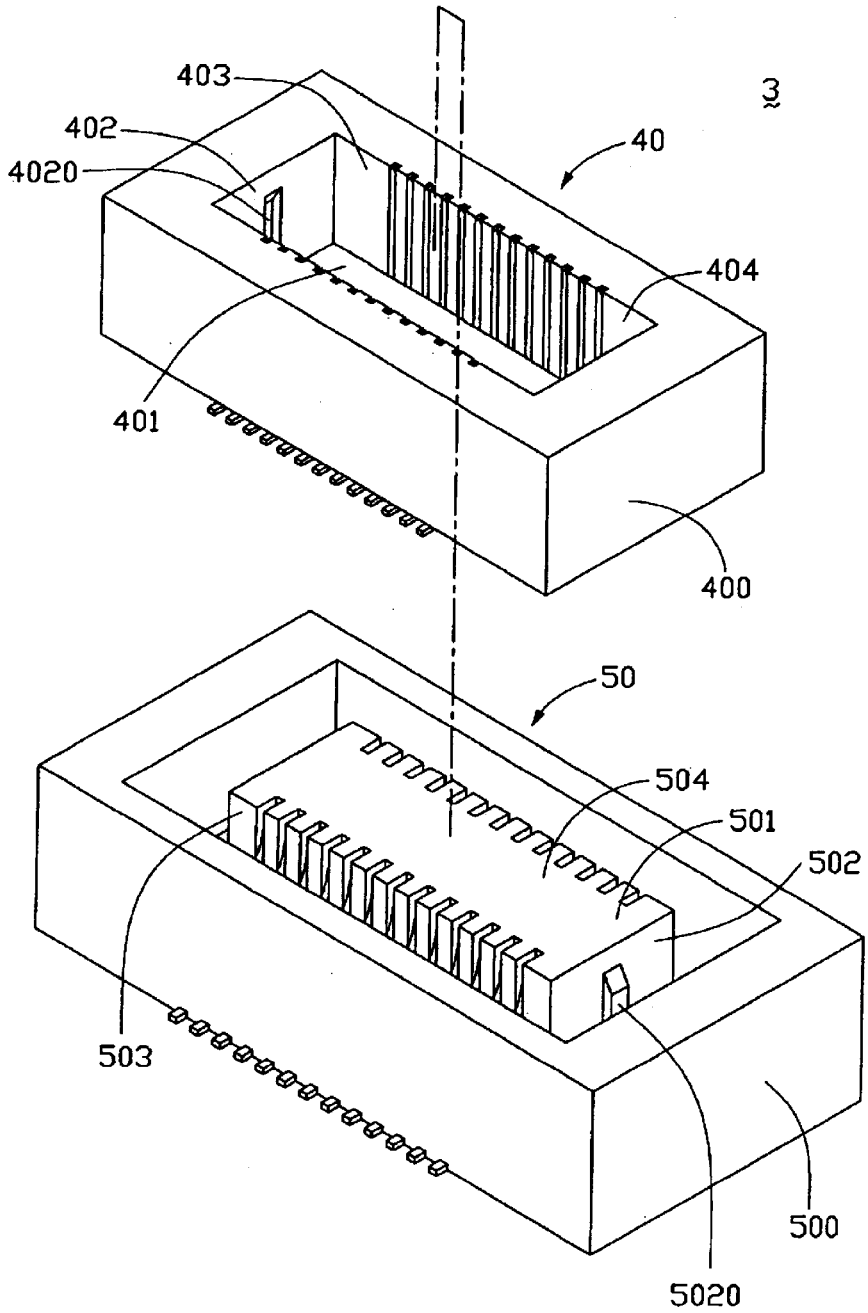
FIG. 6 (PRIOR ART)
FIG. 6 is an exploded, isometric view of a conventional electrical connector assembly.

Referring to FIG. 5, an electrical connector assembly 1' in accordance with an alternative embodiment of the present invention has a structure similar to that of the electrical connector assembly 1 of the preferred embodiment. The electrical connector assembly 1' comprises a first connector 10', and a second connector 20' adapted for being mated with the first connector 10'. The first connector 10' comprises a rectangular protruding portion 102' having a pair of opposite lateral first matching walls 1022'. Each first matching wall 1022' has a central projection 1023' formed vertically in a center thereof. The projection 1023' comprises a pair of curved first interference blocks 1025' protruding from opposite two sidewalls thereof, proximate to a first top wall of the protruding portion 102'.

The second housing 200' defines a receiving space 202' corresponding to the protruding portion 102' of the first housing 100'. The receiving space 202' comprises a pair of opposite lateral second matching walls 2022'. Each second matching wall 2022' has a central recess 2023' defined vertically through a center thereof. A pair of curved first interference blocks 2025' protrudes from opposite two inner sidewalls bounding the recess 2023', proximate to a second top wall of the second connector 20'. The electrical connector assembly 1' can perform substantially the same function as described above in relation to the electrical connector assembly 1 of the preferred embodiment.

While preferred embodiments in accordance with the present invention have been shown and described, equivalent modifications and changes known to persons skilled in the art according to the spirit of the present invention are considered within the scope of the present invention as defined in the appended claims.

What is claimed is:

1. An electrical connector assembly comprising:

a first connector comprising a first housing and a plurality of first terminals received in the first housing, the first housing having a protruding portion; and a second connector mating with the first connector and comprising a second housing and a plurality of second terminals received in the second housing, the second housing having a receiving space for receiving the protruding portion of the first housing;

wherein the first connector comprises a plurality of recesses and a plurality of projections, the second connector comprises the other of the recesses and the projections, each recess comprises two opposite first interference blocks protruding from two opposite inner side walls thereof, each projection comprises two opposite second interference blocks protruding from two opposite side walls thereof, the first interference blocks interferentially engaged with the second interference blocks.

2. The electrical connector assembly as described in claim 1, wherein the protruding portion comprises a pair of opposite first contact walls, and a pair of opposite first matching walls interconnecting the first contact walls respectively.

3. The electrical connector assembly as described in claim 1, wherein the receiving space comprises a pair of opposite second contact walls, and a pair of opposite second matching walls interconnecting the second contact walls respectively.

4. The electrical connector assembly as described in claim 1, wherein each recess is defined in a center of its corresponding first matching wall of the protruding portion.

5. The electrical connector assembly as described in claim 1, wherein each recess if defined in a center of its corresponding second matching walls of the receiving space.

6. The electrical connector assembly as described in claim 1, wherein each projection is formed in a center of its corresponding second matching walls of the receiving space.

7. The electrical connector assembly as described in claim 1, wherein each projection is formed in a center of its corresponding first matching walls of the protruding portion.

8. The electrical connector assembly as described in claim 1, wherein the two second interference blocks are interferentially engaged with two first interference blocks, respectively.

9. An electrical connector assembly comprising:

a first connector comprising a first housing, a plurality of first terminals received in the first housing, the first housing having a protruding portion, the protruding portion comprising a plurality of recesses; and a second connector mating with the first connector and comprising a second housing, a plurality of second terminals received in the second housing, the second housing having a receiving space for receiving the protruding portion of the first housing, the receiving space having a plurality of projections corresponding to the recesses of the protruding portion;

wherein each recess of the protruding portion comprises two opposite first interference blocks protruding from two opposite inner side walls thereof, each projection of the receiving space comprises two opposite second interference blocks protruding from two opposite side walls thereof, the first interference blocks interferentially engaged with the second interference blocks.

10. The electrical connector assembly as described in claim 9, wherein the protruding portion comprises a pair of opposite first contact walls, and a pair of opposite first matching walls interconnecting the first contact walls respectively.

11. The electrical connector assembly as described in claim 10, wherein each recess of the protruding portion is formed in a center of its corresponding first matching wall of the protruding portion.

12. The electrical connector assembly as described in claim 9, wherein the receiving space comprises a pair of opposite second contact walls, and a pair of opposite second matching walls interconnecting the second contact walls respectively.

13. The electrical connector assembly as described in claim 12, wherein each projection is formed in a center of its corresponding second matching wall of the receiving space.

14. An electrical connector assembly comprising:

mated first and second connectors commonly defining thereof lengthwise, lateral and mating directions perpendicular to one another, the first connector defining a first insulative housing with a main central protruding portion thereof;

the second connector defining a second insulative housing with thereof a main receiving space accommodating said protruding portion therein;

a pair of elongated recesses extending along the mating direction and respectively formed in two opposite lengthwise ends of one of said first and second housings; and a pair of elongated projections extending along the mating direction and respectively formed on two opposite lengthwise ends of the other of said first and second housings, and respectively received in the corresponding recesses; wherein at least one pair of said pair of elongated recesses and said pair of elongated projections are equipped with thereof interference blocks protruding outwardly respectively from two opposite lateral side of recesses and projections in the lateral direction so as to reinforce interengagement between the first and second connectors.

15. The electrical connector assembly as described in claim 14, wherein each of said elongated projections is formed with a chamfer at an uppermost end, and said chamfer essentially defines a slope in the lengthwise direction.

16. The electrical connector assembly as described in claim 14, wherein each of said recesses is equipped with, a pair of chamfered structures at an uppermost end, and each of said chamfered structures defines a slope in the lateral direction.

* * * * *